United States Patent [19]

Hillberg

[11] 4,141,164

[45] Feb. 27, 1979

[54] MAGAZINE ISOLATOR FOR PUMP SHOTGUNS

[75] Inventor: Robert L. Hillberg, Chesire, Conn.

[73] Assignee: Browning Arms Company, Morgan, Utah

[21] Appl. No.: 870,428

[22] Filed: Jan. 18, 1978

[51] Int. Cl.[2] ..... F41C 13/00

[52] U.S. Cl. ..... 42/17

[58] Field of Search ..... 42/17, 21, 49 R

[56] References Cited

U.S. PATENT DOCUMENTS 816,591 4/1906 McClean ..... 42/17

*Primary Examiner*—Charles T. Jordan

*Attorney, Agent, or Firm*—Trask & Britt

[57] ABSTRACT

A magazine isolator is provided for a shutgun having a pump action of conventional type, including sliding linkage, operable sequentially from a battery position through an eject position and loading sequence back to the battery position. The magazine isolator has a selector adapted to the tubular magazine of the shotgun. The selector is movable between a single shot position and a repeat position. A stop surface is fixed to the sliding linkage of the pump action for contact with a shoulder associated with the selector. Upon positioning the selector in the single shot position, the shoulder is positioned for contact with the stop surface to inhibit the pump action from operating past the eject position. A spring loaded detent arrangement is adapted to selectively latch the selector in either the repeat or single position.

6 Claims, 3 Drawing Figures

MAGAZINE ISOLATOR FOR PUMP SHOTGUNS

BACKGROUND OF THE INVENTION

1. Field

This invention relates to shotguns. More particularly, this invention provides a magazine insolator for use with shotguns of the type having tubular magazines and a pump action.

2. State of the Art

Shotguns of the type having tubular magazines and a pump action which includes sliding linkage are well known. The pump action of such shotguns is operable from a battery position through an eject position to eject a cartridge from the firing chamber and through a loading sequence in which cartridges are released from the mouth of the tubular magazine sequentially one by one and positioned for ramming into the firing chamber. The action is then positioned back to the battery position through which the cartridges are rammed into the firing chamber. Shotguns of this type come in various gauges (bore) and may be of the type in which cartridges are ejected outwardly or away from the side of the receiver or of the type in which cartridges are ejected downwardly from the receiver.

In operation, the user may find it desirable to load the tubular magazine with a plurality of cartridges and to thereafter fire several cartridges in sequence by operating the pump action after each firing. In some cases, the user may find it desirable to load into the firing chamber a cartridge of a type different from those preloaded into the magazine. Such operation may be found desirable in the field (hunting) to permit selection of the type of shot appropriate for the specific game present at a given moment. In such instances, as in other sporting environments such as trap shooting where the user desires to individually load cartridges into the firing chamber, the carrier mechanism inevitably associated with tubular magazines generally interfers with manual loading.

In such circumstances, the user may sometimes position the pump action precisely to eject a spent cartridge without causing a new cartridge to be released from the magazine. This mode of pump operation is impossible for many shotguns, and at best is difficult and/or awkward. Alternatively, the user may repeatedly operate the pump action to load cartridges from the magazine into the firing chamber and thereafter eject unfired cartridges until the magazine and the firing chamber are empty of the preloaded cartridges. Thereupon, the user may load the desired cartridge into the magazine or directly into the firing chamber. This procedure is time consuming and often dangerous. There is a need for a simple means to permit loading of a single cartridge directly into the firing chamber of a pump action shotgun without interference from the cartridges stored in the magazine or the carrier mechanism of the gun.

SUMMARY OF THE INVENTION

A magazine isolator has a selector adapted to a shotgun proximate the pump action. The selector is operable between a repeat position and a single position. Disable means are structurally associated with the pump action and the selector to selectively mechanically inhibit the pump action from operating past the eject position when the selector is in the single position. The pump action is of the type which has sliding linkage and which is operable sequentially from a battery position through an eject position to eject the cartridge from the firing chamber and through a load sequence in which the cartridges are released from the mouth of a tubular magazine sequentially one by one and positioned for ramming into the firing chamber and back to the battery position whereby the cartridge is rammed into the firing chamber. The disable means preferably includes a stop surface fixedly associated with the sliding linkage of the pump action. The disable means also includes engaging means mechanically operable by the selector so that upon positioning of the selector in the single position the engaging means are positioned for contact with the stop surface.

The engaging means is preferably a shoulder unitary with the selector, and the selector is most conveniently adapted to the tubular magazine of the shotgun proximate the mouth thereof. In a highly preferred embodiment, the selector is semicircular in cross-section with the shoulder formed on one end thereof. The selector is preferably sized in perimeter greater than one-half the perimeter of the tubular magazine and sized in diameter to snugly and rotatably fit about the tubular magazine.

In another embodiment, the magazine selector includes latching means structurally associated with the selector and the shotgun selectively to latch the selector in either the single or repeat position. The latching means may comprise a spring loaded latch element adapted to the selector and detents formed in adjacent structure of the shotgun to coact with the latch element, the detents being located to register the selector in the single and repeat positions, respectively.

BRIEF DESCRIPTION OF THE DRAWINGS

In the drawings, which illustrate what is presently contemplated as the best mode for carrying out the invention.

DESCRIPTION OF THE ILLUSTRATED EMBODIMENT

Figure 1:
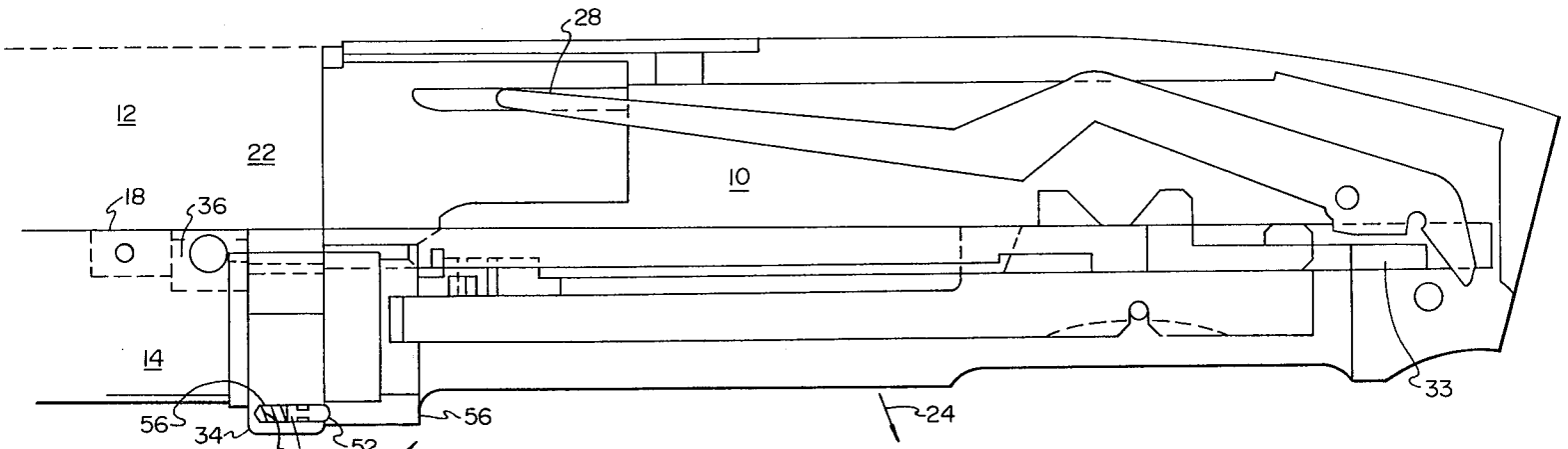
FIG. 1 is a partial cut-away side view of a pump action of a pump shotgun with a magazine selector of the instant invention.

FIG. 1 illustrates portions of a pump shotgun having a receiver 10, a barrel 12 and a tubular magazine 14. A pump actuator or forearm (not shown) is adapted conventionally to slide axially along the tubular magazine 14. It is connected by pins or other means to action bars 16 and 18 of the pump action. The action bars 16, 18 are typically operated from a battery position (ready to fire) through an eject position. As the action bars 16, 18 move to the eject position, a cartridge in the firing chamber 22 is ejected either downwardly below through the pump action or receiver 10 or sideways and outwardly from the receiver 10 as shown by the arrows 24 and 26, respectively.

Figure 2:
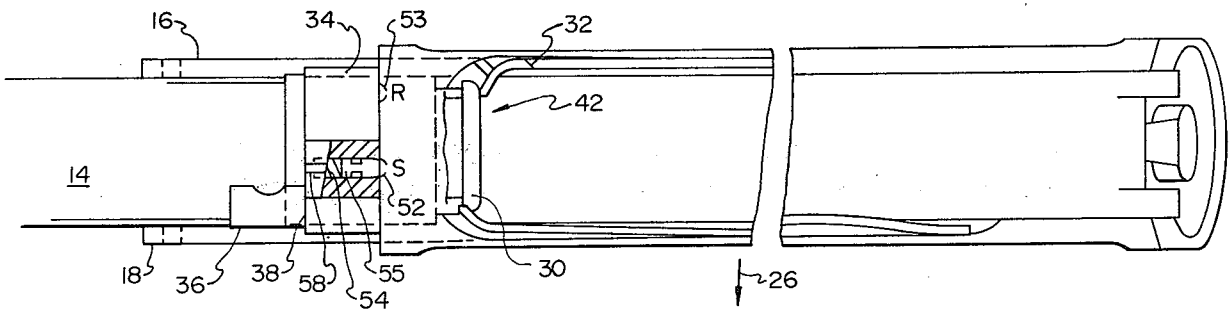
FIG. 2 is a bottom view of the pump action with the magazine selector of FIG. 1.

Typically, the forearm (not shown), and consequently the action bars 16, 18, is moved rearward from the battery position through the eject position continuously in a smooth fashion and then forward to effect a loading sequence. In the loading sequence of the illustrated shotgun, the carrier 28 of the action is initially positioned at the bottom of the receiver 10 to receive a cartridge 30 from the tubular magazine 14 (FIG. 2). The action bars 16, 18, while being moved rearward, contact a cartridge stop 32 to release the cartridge 30 from the magazine. The cartridge is then loaded and/or otherwise urged onto the carrier 28 which in turn transports the cartridge 30 upward for loading or ramming into the firing chamber 22.

The pump action 20, here illustrated, includes a slide 33 which contacts the carrier 28 to effect its movement and the loading sequence hereinbefore described. The shotgun illustrated in FIGS. 1 and 2 is of the type in which ejection is effected downward from the receiver as indicated by the arrow 24 (FIG. 1). The instant invention may also be readily adapted for use with shotguns of the type in which ejection is effected sideways or outwardly from the receiver as indicated by the arrow 26 (FIG. 2).

Figure 3:
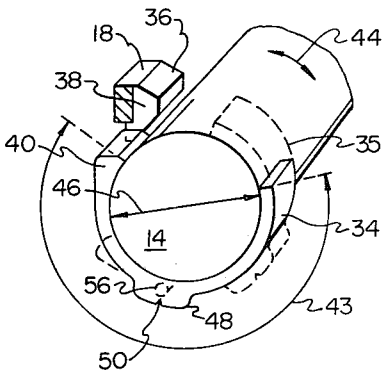
FIG. 3 is a cross-sectional view of a magazine selector of the instant invention in the single position.

As shown, a selector 34 is adapted to the shotgun proximate the receiver 10. The selector 34 is operable between repeat position as shown in phantom by dotted lines 35 in FIG. 3, and a single position, as shown by solid lines in FIG. 3. Disable means are structurally associated with the pump action and the selector 34 to selectively mechanically inhibit the pump action from operating past the eject position when the selector is in the single position (FIG. 3). The disable means preferably includes a stop surface which as here illustrated is a slide stop 36 affixed to the action bar 18. The slide stop 36 has a stop surface 38 fixed to the sliding linkage of the pump action, such as the action bars 16, 18. The disable means also includes engaging means mechanically operable by the selector 34 so that upon positioning the selector 34 in the single position the engaging means is positioned for contact with the stop 36 and in particular the stop surface 38. The engaging means, as here shown, is a shoulder 40 unitary with the selector 34. The selector 34 is adapted to the tubular magazine 14 proximate the mouth 42 thereof.

As best shown in FIG. 3, the selector 34 is semi-circular in cross-section with the shoulder 40 formed on one end thereof. The selector 34 is sized in perimeter 43 to be greater than one-half the perimeter 44 of the tubular magazine 14. The selector 34 is sized in diameter 46 to snugly and rotatably fit about the tubular magazine 14. The selector 34 can thus be manually rotated between the single and repeat 35 positions. In the single position, the shoulder 40 is positioned for contact with the stop surface 38 of the slide stop 36 to inhibit rearward movement of the action bars 16 and 18 from the eject position as shown in FIGS. 1 and 2.

As shown in FIG. 3, the selector 34 has a tab 48 to facilitate manual operation by the user. The tab 48 has a groove 50 formed therein which is filled with a colored paint, such as white paint, to provide a line to index with engraved or painted "S" (single) and "R" (repeat) positions marked on the shotgun. Latching means is provided to latch the selector 34 in position. Preferably, a spring loaded element and detent are used. A pair of detents 52, 53 are formed to coact with a spring 54 and latch element 55 positioned as here shown in the magazine housing. The spring loaded latch element 55 is positioned in an aperture 56 formed in the selector 34.

In operation, the user may position the selector 34 from the repeat position to the single position (FIG. 3) at will. Upon moving the pump forearm (not shown) rearward and in turn moving the action bars 16 and 18 rearward, the slide stop 36 and in turn the stop surface 38 will contact the shoulder 40 and inhibit further rearward movement at a point in which the eject position has been reached. That is, a cartridge positioned in the firing chamber 22 would be ejected from the receiver. The shoulder 40 inhibits further rearward movement of the action bars 16, 18, and in turn inhibits the pump action from effecting the load sequence. The carrier 28 remains out of the way of the chamber 22 and all cartridges 30 stored in the tubular magazine 14 remain in place. Accordingly, the user may load a single cartridge directly and manually into the firing chamber 22. Through the eject path or other loading path provided for the particular gun in use. For some shotguns, and particularly downward eject shotguns, the pump action must be maintained in a precise physical position to provide the clear path. The slide stop 36 is desirably positioned on the action bars 16, 18 to ensure establishing such a position. The user may find it desirable to maintain slight rearward pressure while loading in the single position to maintain proper positioning.

Upon completing the single shot loading operation, the user may simply return the pump action to its battery position. For repeat shot operation, the selector 34 is repositioned from the single (S) position to the repeat (R) position. Thereafter, the pump action may be operated in a conventional manner.

It is to be understood that the embodiments of the invention above described are merely illustrative of the application of the principals of the invention. Reference herein to details of the illustrated embodiment is not intended to limit the scope of the claims which themselves recite those features regarded as essential to the invention.

I claim:

1. A magazine isolator for a shotgun having a pump action operable sequentially from a battery position through an eject position to eject a cartridge from the firing chamber, through a load sequence in which cartridge are released from the mouth of a tubular magazine sequentially one and back to said battery position in which the cartridge is rammed into said firing chamber, said isolator comprising:

a selector mounted proximate said pump action and operable between a repeat position and a single position; and disable means structurally associated with said pump action and said selector to selectively mechanically inhibit said pump action from operating past said eject position when said selector is in said single position.

2. The magazine isolator of claim 1 wherein said disable means includes:

a stop surface fixedly associated with sliding linkage of said pump action;

engaging means mechanically operable by said selector so that upon positioning said selector in said single position said engaging means is positioned for contact with said stop surface upon operation of said pump action to inhibit pump action operation past said eject position into said load sequence.

3. The magazine isolator of claim 2 wherein said engaging means is a shoulder unitary with said selector and wherein said selector is adapted to said tubular magazine proximate the mouth thereof.

4. The magazine isolator of claim 3 wherein said selector is semicircular in cross-section with said shoulder formed on one end thereof and which is sized in perimeter greater than one-half the perimeter of said tubular magazine and sized in diameter to snugly and rotatably fit about said tubular magazine.

5. The magazine isolator of claim 2 including latching means structurally associated with said selector and said shotgun to latch said selector in said single and repeat positions.

6. The magazine isolator of claim 5 wherein said latching means is a spring loaded latch element carried by said selector to coact with detents associated with said magazine at said single and repeat positions to index with said latch element.

* * * * *

UNITED STATES PATENT AND TRADEMARK OFFICE

CERTIFICATE OF CORRECTION

PATENT NO. : 4,141,164

DATED : February 27, 1979

INVENTOR(S) : Robert L. Hillberg

It is certified that error appears in the above-identified patent and that said Letters Patent are hereby corrected as shown below:

In the Abstract, line 1, "shutgun" should read --shotgun--.

Signed and Sealed this

*Third* Day of *July 1979*

[SEAL]

*Attest:*

*Attesting Officer*

LUTRELLE F. PARKER

*Acting Commissioner of Patents and Trademarks*